US010927788B2

(12) United States Patent
Bischofberger et al.

(10) Patent No.: US 10,927,788 B2
(45) Date of Patent: Feb. 23, 2021

(54) PISTON OF AN INTERNAL COMBUSTION ENGINE

(71) Applicant: Mahle International GmbH, Stuttgart (DE)

(72) Inventors: Ulrich Bischofberger, Esslingen (DE); Sascha-Oliver Boczek, Dielheim (DE)

(73) Assignee: Mahle International GmbH

( * ) Notice: Subject to any disclaimer, the term of this patent is extended or adjusted under 35 U.S.C. 154(b) by 0 days.

(21) Appl. No.: 15/611,461

(22) Filed: Jun. 1, 2017

(65) Prior Publication Data

US 2017/0350345 A1 Dec. 7, 2017

(30) Foreign Application Priority Data

Jun. 2, 2016 (DE) ..... 10 2016 209 651
Dec. 6, 2016 (DE) ..... 10 2016 224 280

(51) Int. Cl.

| | |
|---|---|
| ***F02F 3/18*** | (2006.01) |
| ***F01P 3/10*** | (2006.01) |
| ***F02F 3/00*** | (2006.01) |
| *F01P 3/12* | (2006.01) |
| *F01P 3/20* | (2006.01) |
| *F01P 3/06* | (2006.01) |
| *F02B 23/00* | (2006.01) |
| *F02F 3/22* | (2006.01) |

(52) U.S. Cl.

CPC ..... *F02F 3/18* (2013.01); *F01P 3/10* (2013.01); *F02F 3/0076* (2013.01); *F02F 3/0084* (2013.01); *F01P 3/06* (2013.01); *F01P 3/12* (2013.01); *F01P 3/20* (2013.01); *F02B 23/00* (2013.01); *F02F 3/00* (2013.01); *F02F 3/22* (2013.01); *F02F 2200/04* (2013.01)

(58) Field of Classification Search

CPC ..... F02F 3/18; F02F 3/0076; F02F 3/0084; F02F 2200/04; F02F 3/00; F02F 3/22; F01P 3/10; F02B 23/00
USPC ..... 123/41.16, 41.31, 41.34, 193.6
See application file for complete search history.

(56) References Cited

U.S. PATENT DOCUMENTS 2,309,555 A * 1/1943 Bowser, Jr. ..... F02F 3/02 92/233
2,418,053 A * 3/1947 Sipe ..... F16J 1/06 92/195
2,983,565 A * 5/1961 Tsang ..... F16J 1/06 92/195
3,240,193 A * 3/1966 Ephraim, Jr. ..... F02F 3/0076 123/41.35

(Continued)

FOREIGN PATENT DOCUMENTS

AT 164701 B 12/1949
CN 86105124 A 2/1987

(Continued)

OTHER PUBLICATIONS

English abstract for DE-102012207951.

(Continued)

*Primary Examiner* — Syed O Hasan
(74) *Attorney, Agent, or Firm* — Fishman Stewart PLLC

(57) ABSTRACT

A piston of an internal combustion engine may include a piston shaft and a piston head. The piston head may be provided with a closed cooling channel with a cooling medium arranged therein. The piston shaft may have a spherically round cross-sectional shape, wherein a deviation from the roundness with respect to a piston diameter may be less than 0.5 per thousand.

20 Claims, 2 Drawing Sheets

(56) References Cited

U.S. PATENT DOCUMENTS

| | | | | |
|---|---|---|---|---|
| 6,318,243 | B1 | 11/2001 | Jones | |
| 6,920,860 | B2 * | 7/2005 | Gabriel | F02F 3/22 123/193.6 |
| 9,777,668 | B2 * | 10/2017 | Pisila | B23P 15/10 |
| 2007/0095201 | A1 | 5/2007 | Donahue | |
| 2007/0289568 | A1 * | 12/2007 | Scharp | F02F 3/003 123/193.6 |
| 2014/0290618 | A1 * | 10/2014 | Bischofberger | F02F 3/16 123/193.6 |
| 2015/0247475 | A1 | 9/2015 | Bischofberger et al. | |
| 2016/0298572 | A1 | 10/2016 | Azevedo | |
| 2017/0138297 | A1 | 5/2017 | Laqua et al. | |

FOREIGN PATENT DOCUMENTS

| | | | |
|---|---|---|---|
| CN | 104204485 | A | 12/2014 |
| DE | 3740820 | C1 | 1/1989 |
| DE | 102012207951 | A1 | 11/2013 |
| DE | 102012017217 | A1 | 5/2014 |
| DE | 102014010156 | A1 | 7/2015 |
| DE | 102015212445 | A1 | 1/2016 |
| FR | 2883334 | A1 | 9/2006 |
| GB | 2107427 | A | 4/1983 |
| JP | H09170490 | A | 6/1997 |

OTHER PUBLICATIONS

English abstract for DE-102014010156.
English abstract for DE-3740820.
English abstract for FR-2883334.
English abstract for JP-H09170490.
Engilsh abstract for CN-86105124.
Chinese Office Action for CN-201710373993.0, dated Jun. 16, 2020.

* cited by examiner

PISTON OF AN INTERNAL COMBUSTION ENGINE

CROSS-REFERENCE TO RELATED APPLICATIONS

This application claims priority to German Patent Applications DE 10 2016 209 651.6, filed Jun. 2, 2016, and DE 10 2016 224 280.6, filed on Dec. 6, 2016, the contents of both of which are incorporated herein by reference in their entireties.

TECHNICAL FIELD

The present invention relates to a piston of an internal combustion engine having a piston shaft and a piston head. The invention further relates to an internal combustion engine having at least one such piston.

BACKGROUND

In current, supercharged diesel engines, as a result of the very high specific power levels of over 60 kW per litre cubic capacity, there is often a powerful thermal loading of the pistons of the internal combustion engine and in particular a piston base. The piston base in this instance faces the combustion chamber with the combustion chamber bowl thereof and consequently has to withstand the highest thermal loading. In order to be able to operate such an internal combustion engine or such a diesel engine in the long term, it is necessary to carry out a cooling of the piston which in particular reduces the thermal loading of the piston, in particular in the piston head thereof, and furthermore to prevent coking of oil which takes up the lubrication of the piston in a cylinder, in particular in an annular groove which is adjacent to a top land.

This problem is solved according to the invention by the subject-matter of independent claim 1. The dependent claims relate to advantageous embodiments.

SUMMARY

The present invention is based on the general notion of constructing a shaft form of a piston of an internal combustion engine in such a manner that it has an increased abutment face against a cylinder wall or a cylinder liner which is arranged in an associated cylinder and thereby an improved heat transfer and also improved cooling of the piston can be achieved. The piston according to the invention has in this instance the said piston shaft and a piston head, in which a closed cooling channel with a cooling medium arranged therein is provided.

A combustion chamber bowl is further arranged in the piston head. According to the invention, the piston shaft now has a spherical and at the same time round cross-sectional shape which differs significantly from the spherical and oval cross-sectional shapes previously known from the prior art, and wherein a deviation from the roundness with respect to a piston diameter is less than 0.5 per thousand. The term "spherical" in this instance is intended to mean that the piston is constructed along the piston axis thereof in the manner of a barrel, that is to say, a diameter of the piston in the region of the piston head and in the region at a lower end of the piston shaft is smaller than therebetween. The deviation of the roundness should in this instance always be considered in a plane transverse relative to the piston axis. Over the height, therefore, the radii differ as a result of the convexity. The spherical construction enables in this instance a round sliding of the shaft wall on the cylinder or on the cylinder liner during the change of abutment of the piston. As a result of the spherically round embodiment of the shaft wall, according to the invention the face which is in abutment with the cylinder or the cylinder liner increases and consequently also the possibility of heat transfer from the piston to the cylinder. Tests have in this instance already shown that, as a result of the spherical and round embodiment of the piston shaft according to the invention and the consequently improved heat transfer, a significant temperature reduction can be achieved in the piston head.

In an advantageous development of the solution according to the invention, a thermally conductive coating is arranged on a shaft face of the piston. Via such a thermally conductive coating which has, for example, an increased graphite proportion and consequently an improved thermal conductivity, an additionally improved heat transfer from the piston to the cylinder and consequently an improved cooling of the piston can be achieved.

In an advantageous development of the solution according to the invention, the cooling channel is expanded radially outwards in the region of a piston base in the direction of a top land. The top land extends from the piston base as far as the first annular groove in order to receive a piston ring. As a result of the expansion of the cooling channel as provided for according to the invention in a radial direction outwards in the direction of the top land, the temperature in the first annular groove can be reduced by up to 10 K, whereby in particular the problem of oil carbon formation in the said first annular groove can be prevented, but at least greatly reduced. Additionally or alternatively, the cooling channel can also be expanded in the region of a piston base in the direction of the combustion chamber bowl, that is to say, radially inwards. It is also thereby possible to obtain improved cooling of the piston.

In another advantageous development of the solution according to the invention, the piston is constructed in two parts with an upper portion and a lower portion which is connected thereto, in particular welded thereto, wherein the cooling channel is formed partially in the upper portion and partially in the lower portion. Such a multi-component piston affords in this instance the possibility of expanding the cooling channel downwards in the direction of the shaft by means of milling and/or bores and thereby achieving improved heat discharge of the cooling medium which is thrown back and forth in the closed cooling channel during operation in the direction of the piston shaft. If the cooling channel is, for example, expanded in the direction of the piston shaft by means of milling, it has, on an inner wall which faces a lower piston side, an undulating shape which leads to an increased surface and consequently also to an improved heat transfer. In addition to such a hollow milling, which also brings about the undulating shape of the cooling channel base as a result of the process, additional bores which extend significantly deeper into the piston shaft and thereby bring about a further improved heat discharge may be provided.

In an advantageous development of the solution according to the invention, ribs which protrude from the lower piston side are arranged in the region of the cooling channel at a lower piston side. These ribs preferably extend only over the region between inner shaft walls and the connection thereof to a piston base and at the same time have several functions: on the one hand, as a result of such ribs, the surface increases by at least 1.2 to 2 times, whereby a heat transfer to the oil which is injected from below is also increased and thereby the heat discharge and on the whole the cooling of the piston can be improved. On the other hand, the ribs guide the injected oil over a centre axis towards the opposing side. In addition, with such pistons, the injection nozzle for the oil can be positioned in an oblique manner, whereby an impact location of the oil jet moves depending on the piston position between the top dead centre and the bottom dead centre and thereby brings about a particularly uniform cooling. As a result of open cooling channels, this cannot be implemented in such a manner because the oil jet always has to be directed onto a supply hole of the open cooling channel in order to always be able to inject sufficient oil into the cooling channel.

Advantageously, the ribs are produced by means of stamping/forging. The production of the ribs and the recesses which are arranged therebetween can consequently be produced without significant additional expenditure when the piston is produced, for which a stamping or forging die simply has to be adapted accordingly.

In another advantageous embodiment of the solution according to the invention, the ribs extend substantially in a radial direction with respect to a piston axis, wherein there may additionally or alternatively be provision for the recesses which are described above to be arranged between the ribs and wherein a volume of the ribs which protrude from the lower piston side corresponds to the volume of the recesses which are stamped in the lower piston side. A volume compensation between recesses and ribs takes place during stamping or forging of the ribs only locally by means of flowing of the material, whereby only a very small loading or no additional loading at all is produced for the forging tool and the service-life of the tool is not influenced or is influenced only in an insignificantly negative manner.

There is preferably used as cooling medium, for example, sodium and/or potassium, wherein there are also considered in particular admixtures thereof which become liquid, for example, at −12° C. and during operation of the internal combustion engine are shaken back and forth by the back-and-forth movement of the piston and thereby absorb heat from the piston base and discharge it into the piston shaft. Alternatively, water can also be used as a cooling medium. Water affords the advantage that it is very cost-effective and a far less complex filling installation can be used for it. Furthermore, it is available everywhere and does not pose any risk to humans and the environment. The operating principle has a similar basis in this instance to a heatpipe with which it is possible to transmit large quantities of heat. Such a "heatpipe" uses the evaporation and condensation enthalpy of the cooling medium (operating medium). The water evaporates in the upper region of the cooling channel which faces the piston base and the bowl wall and condenses in the lower portion of the cooling channel, where the heat is discharged, for example, to the piston shaft. As a result of the pressures which become increasingly high as the temperature of the cooling medium rises, a correspondingly constructed closure element should be used, for example, a König Expander, which withstands pressures of up to 350 bar. Furthermore, attention must be paid to the filling quantity since water in comparison with sodium/potassium is a worse heat conductor and the evaporation and condensation enthalpy is the only important aspect. In order where possible not to impede the transport of heat through the water, it is therefore advantageous if there is substantially only so much water available in the cooling channel that the maximum energy which is introduced into the piston during a work cycle evaporates the majority of the water present to the greatest possible extent. A filling quantity typically of from 0.01% to 10% of the volume of the cooling channel should accordingly already be sufficient to transport the heat from the hot locations of the piston into colder regions. The function of this method is in this instance connected with the physical properties of water, according to which, during transition from the liquid phase into the gas phase, heat is absorbed and, vice versa when the water vapour is condensed, heat is discharged to the environment. The function is accordingly limited in an upward direction to a maximum temperature of 374° C. (critical temperature) since above the critical temperature there occurs no phase jump. In a downward direction, the melting point of the water 0° C. has a limiting action. It has been found that in particular for steel pistons during operation of the engine, this temperature range is not left. Typically, temperatures from 100 to 300° C. are observed. The extent of the expansion of the cooling channel under pressure naturally has to be taken into account during the configuration which may lead to greater wall thicknesses in the region of the cooling channel. The pressure varies in this instance typically between 50 to 100 bar at a maximum, depending on the respective engine concept. At high specific power levels, it has been found that, as a result of the addition of salt or highly thermally conductive powders (for example, based on copper, aluminium, silicon carbide or low-melting metals such as tin, an SnBi-eutectic, bismuth or gallium), the boiling power of the water is significantly increased and the film boiling which otherwise occurs from a heat flow density of approximately 1000 $kW/m^2$ can be displaced to higher heat flow densities.

Other important features and advantages of the invention will be appreciated from the dependent claims, the drawings and the associated description of the Figures with reference to the drawings.

Of course, the features which are mentioned above and those which will be explained below can be used not only in the combination set out in each case, but also in other combinations or alone without departing from the scope of the present invention.

Preferred embodiments of the invention are illustrated in the drawings and are explained in greater detail in the following description, wherein identical reference numerals relate to identical or similar or functionally identical components.

DETAILED DESCRIPTION

Figure 1:
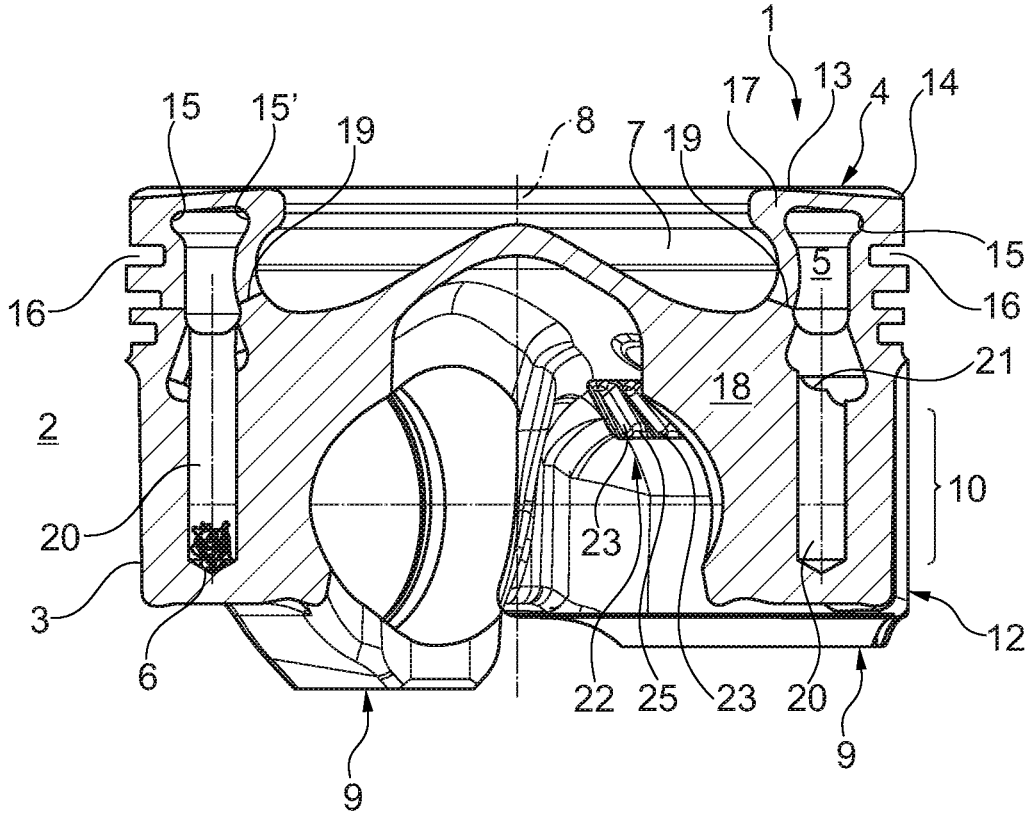
FIG. 1 is a sectioned illustration through a piston according to the invention with a plane of section which is different in the left half of the image and the right half of the image.
Figure 2:
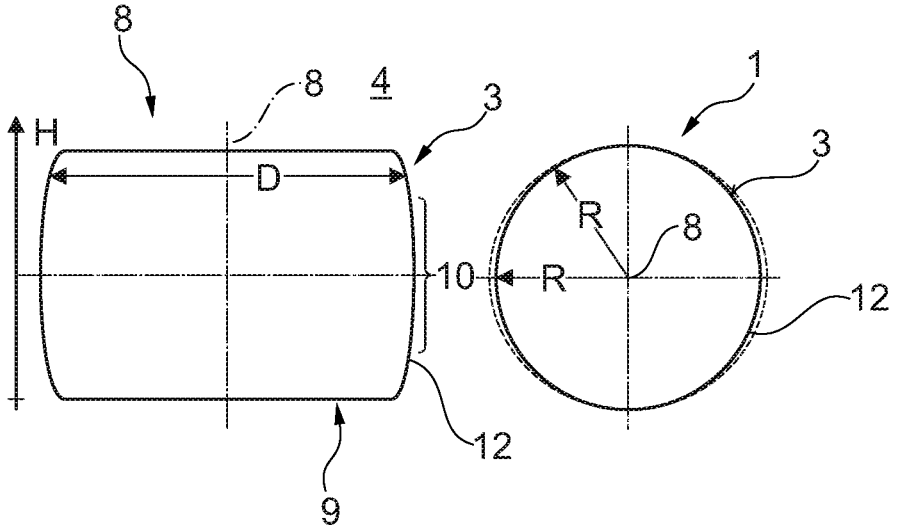
FIG. 2 is an illustration of the generically spherically round cross-sectional shape with different views.
Figure 3:
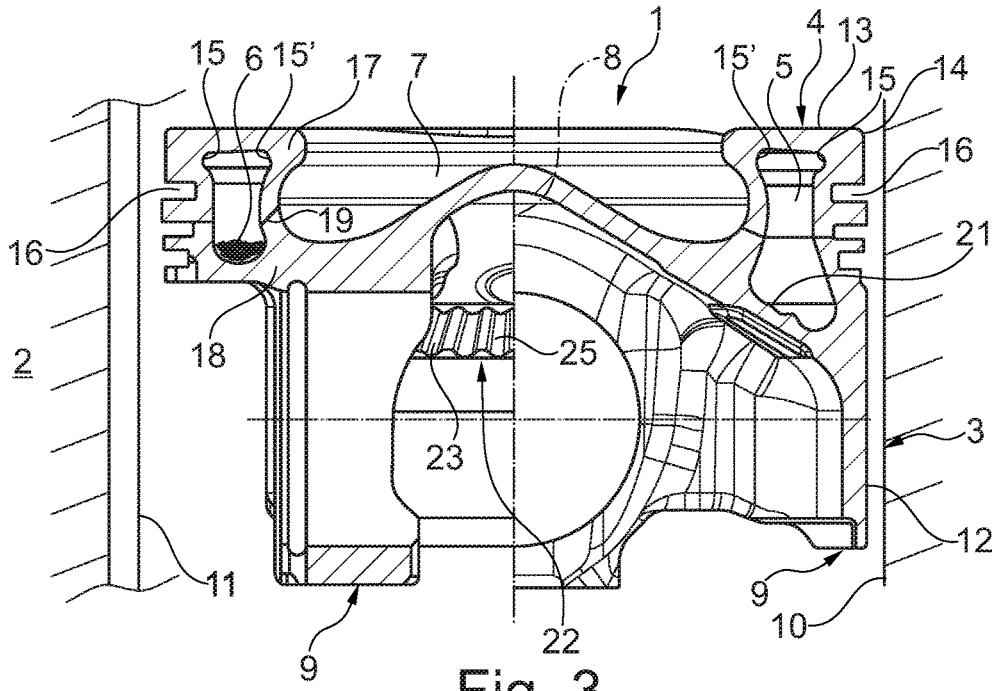
FIG. 3 is an illustration as in FIG. 1, but with different planes of section.

According to FIGS. 1 and 3, a piston 1 according to the invention of an internal combustion engine 2 which is illustrated only in a highly schematic manner in FIG. 3 has a piston shaft 3 and a piston head 4, wherein a closed cooling channel 5 with a cooling medium 6 which is arranged therein is provided in the piston head 4. A combustion chamber bowl 7 is further arranged in the piston head 4 itself. According to the invention, the piston shaft 3 now has a spherically round cross-sectional shape (cf. also FIG. 2), wherein a piston axis is indicated with the reference numeral 8 and wherein a deviation from the roundness with respect to a piston diameter D is smaller than 0.5 per thousand. The term "spherical" is intended to mean in this instance that the piston 1 is constructed along the piston axis 8 thereof in the manner of a barrel, that is to say that a diameter D of the piston 1 in the region of the piston head 4 and in the region at a lower end of the piston shaft 3 is smaller than therebetween. The deviation of the roundness is in this instance always intended to be considered in a plane transverse relative to the piston axis 8. Over the height H, the radii R therefore differ as a result of the roundness whilst they are identical in a plane.

If the left-hand illustration in FIG. 2 is considered, it can be seen that the spherical shape with respect to the piston axis 8 in the upper end and at a lower end 9 of the piston shaft 3 has a smaller diameter D than, for example, in a central region 10 of the piston shaft 3. In the right-hand illustration of FIG. 2, for example, the spherically round cross-sectional shape in comparison with a spherically oval cross-sectional shape known from the prior art is illustrated. The spherically round cross-sectional shape is in this instance indicated with a continuous line, whilst the spherically oval cross-sectional shape, as known from piston shafts of pistons from the prior art is illustrated with a broken line. The spherically round cross-sectional shape of the piston shaft 3 according to the invention is consequently distinguished by a circular cross-sectional shape having a radius R which is constant at a respective height level H.

As a result of the spherical round cross-sectional shape of the piston shaft 3 according to the invention, it is not only possible to achieve improved sliding of the piston shaft 3 on a cylinder wall 10 (cf. FIG. 3) or on a cylinder liner 11, if such a liner is arranged in the cylinder, but especially an abutment face 12 is increased, that is to say, a contact face between the piston shaft 3 and the cylinder wall 10 or the cylinder liner 11 which may be arranged in the cylinder, whereby improved heat transfer can be achieved. With pistons which have previously been known from the prior art and which have a spherically oval cross-sectional shape, these were in contact with only a small portion of the shaft face thereof with a cylinder wall or cylinder liner, whereby only a small amount of heat could be discharged from the piston to the cylinder and consequently also significantly reduced cooling of the piston was possible.

If FIGS. 1 and 3 are considered further, it can be seen that the cooling channel 5 is expanded outwards in a radial direction in the region of the piston base 13, that is to say, in the direction of a top land 14, or has such an expansion 15. The temperature in a first annular groove 16 can thereby be reduced by up to 10 K, whereby the problem of oil carbon formation and in particular also the coking of the oil which is required for lubrication of the piston 1 in the cylinder can be prevented but at least significantly reduced. Additionally or alternatively, such an expansion 15' may also be provided radially inwardly in the direction of the combustion bowl 7.

If FIGS. 1 and 3 are considered further, it can be seen that the piston 1 is constructed in multiple parts, in this instance in two parts, with an upper portion 17 and a lower portion 18 which is connected thereto, in particular welded thereto, wherein the cooling channel 5 is formed partially in the upper portion 17 and partially in the lower portion 18. The upper portion 17 and the lower portion 18 are in this instance connected to each other along a joining plane 19, for example, friction or laser welded. In order to be able to expand the cooling channel 5 in a downward direction, there may additionally be provided bores 20 which extend as far as a location close to the lower end 9 of the piston shaft 3 (cf. FIG. 1) and thereby bring about an improved heat discharge to the region of the piston shaft 3. The cooling channel 5 may additionally or alternatively also be expanded by means of milling, for example, hollow milling, whereby, at a cooling channel base 21, the undulating shape which is typical at that location is produced as a result of the process. As a result of such an undulating shape at the cooling channel base 21, the surface can be increased and thereby a heat transfer can also be improved.

Additionally or alternatively, there may be arranged at a lower piston side 22 (cf. FIGS. 1, 3 and 4) ribs 25 which preferably extend only over a region between inner shaft walls and the connection thereof to the piston base 13. These ribs 25 have in this instance, on the one hand, the function of increasing the surface, at least by 1.2 times to 2 times, whereby the heat transfer to the oil which is injected from below is also increased. On the other hand, the ribs 25 guide the injected oil over the centre axis (piston axis 8) towards the opposite side. As a result of oblique positioning of an injection nozzle, a movement of an impact location of the oil jet depending on the position of the piston 1 can further be achieved in accordance with the arrow 24 illustrated according to FIG. 4, whereby a particularly uniform cooling can be achieved by means of continuous back-and-forth movement of the oil jet 4 over the ribs 25. The movement of the oil jet is in this instance brought about by the upward and downward movement of the piston 1 between the top dead centre OT and the bottom dead centre UT thereof. The ribs 25 may in this instance preferably be stamped or forged by means of stamping with a corresponding forging or stamping die during the heat shaping process. In this instance, it has been found that this is achieved in a particularly good and simple manner as long as the ribs 25 are constructed in a rounded manner or follow a sinusoidal shape.

Preferably, for example, sodium and/or potassium is used as a cooling medium 6 in the cooling channel 5, wherein there are also considered in particular admixtures thereof which become liquid, for example, at −12° C. and during operation of the internal combustion engine 2 are shaken back and forth by the back-and-forth movement of the piston 1 and thereby absorb heat from the piston base 13 and discharge it to the piston shaft 3. Alternatively, water can also be used as a cooling medium 6. Water affords the advantage that it is very cost-effective and a far less complex filling installation can be used for it. Furthermore, it is available everywhere and does not pose any risk to humans and the environment. The operating principle is in this instance based on the use of evaporation and condensation enthalpy of the cooling medium 6. The water evaporates in the upper region of the cooling channel 5 which faces the piston base 13 and the combustion bowl 7 and condenses in the lower portion of the cooling channel 5, where the heat is discharged, for example, to the piston shaft 3. The operating principle functions in this instance in a similar manner to a heatpipe with which large quantities of heat can be transferred. Such a "heatpipe" uses the evaporation and condensation enthalpy of the cooling medium (operating medium). When water is used as a cooling medium 6, precise attention must be paid to the filling quantity since water in comparison with sodium/potassium is a worse heat conductor and the evaporation and condensation enthalpy is the only important aspect. In order, where possible, not to impede the transport of heat through the water, it is therefore advantageous if there is substantially only so much water available in the cooling channel 5 that the maximum energy which is introduced into the piston 1 during an operating cycle evaporates the majority of the water present to the greatest possible extent. A filling quantity typically of from 0.01% to 10% of the volume of the cooling channel 5 should accordingly already be sufficient to transport the heat from the hot locations of the piston 1 into colder regions. The function of this method is in this instance connected with the physical properties of water, according to which, during the transition from the liquid phase into the gas phase, heat is absorbed and, vice versa when the water vapour is condensed, heat is discharged to the environment. The function is accordingly limited in an upward direction to a maximum temperature of 374° C. (critical temperature) since above the critical temperature, there occurs no phase jump. In a downward direction, the melting point of the water at 0° C. has a limiting action. It has been found that in particular for steel pistons during operation of the engine, this temperature range is not left. Typically, temperatures from 100 to 300° C. are observed. The extent of the expansion of the cooling channel 5 under pressure naturally has to be taken into account during the configuration which may lead to greater wall thicknesses in the region of the cooling channel 5. The pressure varies in this instance typically between 50 and 100 bar, depending on the respective engine concept.

At high specific power levels, it has additionally been found that as a result of the addition of salt or highly thermally conductive powders (for example, based on copper, aluminium or silicon carbide or low-melting metals, such as tin, an SnBi-eutectic, bismuth or gallium), the boiling power of the water is significantly increased and the film boiling which otherwise occurs from a heat flow density of approximately 1000 $kW/m^2$ can be displaced to higher heat flow densities.

Figure 4:
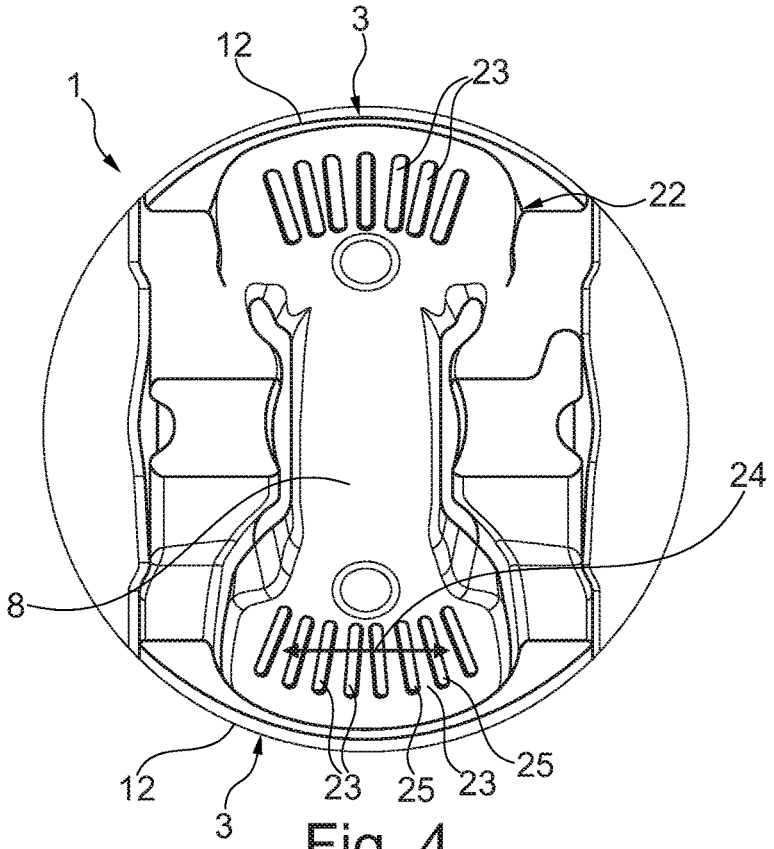
FIG. 4 is a view from below of a piston according to the invention with stamped ribs.

When FIG. 4 is considered, it can be seen that the ribs 25 extend substantially in a radial direction with respect to the piston axis 8, and that recesses 23 are arranged between the individual ribs 25, wherein a volume of the ribs 25 which protrude from the lower piston side 22 corresponds to the volume of the recesses 23 stamped in the lower piston side 22. During the stamping or forging of the ribs, a flowing of the material occurs only locally, whereby only a very small loading or no additional loading at all is produced for the forging tool and the service-life of the tool is not influenced or is influenced only in an insignificantly negative manner. The ribs 25 or the recesses 23 can consequently be introduced in a cost-neutral manner to the greatest extent.

With the piston 1 according to the invention and the spherically round cross-sectional shape thereof, in the region of the piston shaft an abutment face 12 against a cylinder liner 11 or a cylinder wall 10 of the internal combustion engine can be increased, whereby improved heat transfer and consequently also improved cooling of the piston 1 can be achieved, which is a great advantage, in particular for highly supercharged diesel engines with a specific power of over 60 kW per litre cubic capacity.

In addition to the spherically round cross-sectional shape of the piston shaft 3, other measures which promote the cooling of the piston 1, such as, for example, the ribs 25, the bores 20, the expansions 15 can be applied cumulatively or alternatively.

The invention claimed is:

1. A piston of an internal combustion engine, comprising a piston shaft and a piston head provided with a closed cooling channel with a cooling medium arranged therein;

wherein the piston shaft has a spherically round cross-sectional shape in which a piston diameter of an outer sliding surface of the piston is spherical in nature such that the piston diameter in a region of the piston head and in a region at a lower end of the piston shaft is smaller than therebetween, a piston radii of the outer sliding surface differing over a height of the piston while remaining constant in a plane due to the spherically round cross-sectional shape, wherein a deviation from the roundness with respect to the piston diameter is less than 0.5 per thousand.

2. The piston according to claim 1, wherein the cooling channel in a region of a piston base expands radially outwards in a direction of a top land.

3. The piston according to claim 1, comprising an upper portion and a lower portion connected thereto, wherein the cooling channel is formed partially in the upper portion and partially in the lower portion.

4. The piston according to claim 3, wherein the cooling channel expands in the direction of the piston shaft by at least one of milling and bores.

5. The piston according to claim 1, further comprising ribs protruding from a lower piston side and arranged in a region of the cooling channel at the lower piston side.

6. The piston according to claim 5, wherein the ribs are produced by one of stamping and forging.

7. The piston according to claim 5, wherein at least one of:

the ribs extend substantially in a radial direction with respect to a piston axis; and recesses are arranged between the ribs, wherein a volume of the ribs, which protrude from the lower piston side, corresponds to a volume of the recesses, which are stamped in the lower piston side.

8. The piston according to claim 1, wherein at least one of:

the piston is constructed as one of a steel piston or a cast piston of grey cast iron; and the cooling medium has at least one of sodium and one of potassium and water.

9. The piston according to claim 5, wherein the ribs are confined to a region of the lower piston side between inner shaft walls and a connection thereof to a piston base.

10. An internal combustion engine comprising an engine block having at least one cylinder in which a piston is arranged, the piston including:

a piston shaft and a piston head provided with a closed cooling channel with a cooling medium arranged therein;

wherein the piston shaft has a spherically round cross-sectional shape in which a piston diameter of an outer sliding surface of the piston is spherical in nature such that the piston diameter in a region of the piston head and in a region at a lower end of the piston shaft is smaller than therebetween, a piston radii of the outer sliding surface differing over a height of the piston while remaining constant in a plane due to the spherically round cross-sectional shape, wherein a deviation from the roundness with respect to the piston diameter is less than 0.5 per thousand.

11. The internal combustion engine according to claim 10, wherein the cooling channel in a region of a piston base expands radially outwards in a direction of a top land.

12. The internal combustion engine according to claim 10, wherein the piston includes an upper portion and a lower portion connected thereto, wherein the cooling channel is formed partially in the upper portion and partially in the lower portion.

13. The internal combustion engine according to claim 12, wherein the cooling channel expands in the direction of the piston shaft by at least one of milling and bores.

14. The internal combustion engine according to claim 10, wherein the piston includes ribs protruding from a lower piston side and arranged in a region of the cooling channel at the lower piston side.

15. The internal combustion engine according to claim 14, wherein the ribs are produced by one of stamping and forging.

16. The internal combustion engine according to claim 14, wherein at least one of:

the ribs extend substantially in a radial direction with respect to a piston axis; and recesses are arranged between the ribs, wherein a volume of the ribs, which protrude from the lower piston side, corresponds to a volume of the recesses, which are stamped in the lower piston side.

17. The internal combustion engine according to claim 10, wherein at least one of:

the piston is constructed as one of a steel piston or a cast piston of grey cast iron; and the cooling medium has at least one of sodium and one of potassium and water.

18. A piston of an internal combustion engine, comprising:

a piston shaft and a piston head provided with a closed cooling channel with a cooling medium arranged therein;

a plurality of ribs protruding from a lower piston side and arranged in a region of the cooling channel at the lower piston side;

recesses are arranged between the ribs, wherein a volume of the ribs, which protrude from the lower piston side, corresponds to a volume of the recesses, which are stamped in the lower piston side; and ribs protruding from a lower piston side and arranged in a region of the cooling channel at the lower piston side;

wherein the ribs are produced by one of stamping and forging;

wherein at least one of:

the ribs extend substantially in a radial direction with respect to a piston axis; and recesses are arranged between the ribs, wherein a volume of the ribs, which protrude from the lower piston side, corresponds;

wherein the ribs are confined to a region of the lower piston side between inner shaft walls and a connection thereof to a piston base; and wherein the piston shaft has a spherically round cross-sectional shape in which a piston diameter of an outer sliding surface of the piston is spherical in nature such that the piston diameter in a region of the piston head and in a region at a lower end of the piston shaft is smaller than therebetween, wherein a deviation from the roundness with respect to the piston diameter is less than 0.5 per thousand.

19. The piston according to claim 18, wherein the cooling channel in a region of a piston base expands radially outwards in a direction of a top land.

20. The piston according to claim 18, wherein the ribs extend substantially in a radial direction with respect to a piston axis.

* * * * *